US010294746B2

(12) United States Patent
Gilmore et al.

(10) Patent No.: US 10,294,746 B2
(45) Date of Patent: May 21, 2019

(54) RISER GAS HANDLING SYSTEM

(71) Applicant: Cameron International Corporation, Houston, TX (US)

(72) Inventors: David L. Gilmore, Baytown, TX (US); Terry Jason Smith, Houston, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 13/893,190

(22) Filed: May 13, 2013

(65) Prior Publication Data

US 2014/0262313 A1 Sep. 18, 2014

Related U.S. Application Data

(60) Provisional application No. 61/801,884, filed on Mar. 15, 2013.

(51) Int. Cl.

| | |
|---|---|
| ***E21B 43/12*** | (2006.01) |
| ***E21B 34/00*** | (2006.01) |
| ***E21B 33/06*** | (2006.01) |
| ***E21B 33/03*** | (2006.01) |
| ***E21B 17/08*** | (2006.01) |
| ***E21B 33/035*** | (2006.01) |
| ***E21B 33/038*** | (2006.01) |
| ***E21B 33/08*** | (2006.01) |
| ***E21B 17/00*** | (2006.01) |
| ***E21B 17/01*** | (2006.01) |
| ***E21B 19/00*** | (2006.01) |

(Continued)

(52) U.S. Cl.

CPC ..... *E21B 33/035* (2013.01); *E21B 17/006* (2013.01); *E21B 17/01* (2013.01); *E21B 19/004* (2013.01); *E21B 21/08* (2013.01); *E21B 33/038* (2013.01); *E21B 33/064* (2013.01); *E21B 33/085* (2013.01)

(58) Field of Classification Search

CPC ..... E21B 43/12; E21B 33/064; E21B 33/038; E21B 34/00; E21B 21/10; E21B 33/06; E21B 41/0007; E21B 21/106; E21B 33/03; E21B 43/00; E21B 17/06; E21B 17/08; E21B 17/085

USPC ..... 166/344, 347, 363, 364, 368, 373, 86.1; 251/1.1, 1.2, 1.3

See application file for complete search history.

(56) References Cited

U.S. PATENT DOCUMENTS

| | | | |
|---|---|---|---|
| 3,222,088 | A | 12/1965 | Haeber |
| 3,638,721 | A | 2/1972 | Harrison |

(Continued)

FOREIGN PATENT DOCUMENTS

| | | |
|---|---|---|
| EP | 1336721 | 8/2003 |
| GB | 2365044 | 2/2002 |

OTHER PUBLICATIONS

PCT International Search Report and Written Opinion for PCT/US2014/026318, dated Jan. 5, 2015.

*Primary Examiner* — Matthew R Buck
*Assistant Examiner* — Edwin J Toledo-Duran
(74) *Attorney, Agent, or Firm* — Helene Raybaud

(57) ABSTRACT

A system including a modular riser gas handling system configured to couple to and be disposed vertically below a telescoping joint, wherein the modular riser gas handling system includes a diverter assembly configured to couple to and divert a flow of material into and out of a riser, and an annular blow out preventer (BOP) assembly configured to couple to the diverter assembly.

26 Claims, 7 Drawing Sheets

(51) Int. Cl.
*E21B 33/064* (2006.01)
*E21B 21/08* (2006.01)

(56) References Cited

U.S. PATENT DOCUMENTS 4,444,401 A * 4/1984 Roche ..... E21B 21/001 166/363
4,597,447 A 7/1986 Roche et al.
4,626,135 A 12/1986 Roche
4,646,844 A 3/1987 Roche
4,668,126 A * 5/1987 Burton ..... E21B 19/002 166/341
4,828,024 A * 5/1989 Roche ..... E21B 21/001 137/869
4,832,126 A * 5/1989 Roche ..... E21B 21/001 137/114
5,279,365 A * 1/1994 Yenulis ..... E21B 34/16 166/84.3
5,314,024 A * 5/1994 Rodgers ..... F16L 27/06 166/347
6,273,193 B1 8/2001 Hermann et al.
6,352,114 B1 * 3/2002 Toalson ..... E21B 17/01 166/339
6,470,975 B1 10/2002 Bourgoyne et al.
6,474,422 B2 * 11/2002 Schubert ..... E21B 21/001 175/25
6,520,262 B2 * 2/2003 Barnett ..... E21B 33/038 166/339
7,658,228 B2 * 2/2010 Moksvold ..... E21B 17/01 166/345
7,699,109 B2 4/2010 May et al.
7,866,399 B2 * 1/2011 Kozicz ..... E21B 17/01 166/367
7,997,345 B2 * 8/2011 Hannegan ..... E21B 33/085 166/345
8,033,335 B2 * 10/2011 Orbell ..... E21B 17/085 166/367
8,079,426 B2 12/2011 Petersson
8,176,985 B2 * 5/2012 Humphreys ..... E21B 19/002 166/358
8,459,361 B2 * 6/2013 Leuchtenberg ..... E21B 17/07 166/355
8,678,094 B2 3/2014 Banks
9,109,420 B2 8/2015 Tindle et al.
2001/0040052 A1 * 11/2001 Bourgoyne ..... E21B 21/001 175/7
2006/0191716 A1 * 8/2006 Humphreys ..... E21B 19/002 175/5
2007/0095540 A1 * 5/2007 Kozicz ..... E21B 17/01 166/358
2008/0105462 A1 5/2008 May et al.
2008/0251257 A1 * 10/2008 Leuchtenberg ..... E21B 17/07 166/355
2010/0025044 A1 * 2/2010 McKay ..... E21B 33/035 166/359
2011/0061854 A1 * 3/2011 Davies ..... E21B 33/062 166/95.1
2011/0073315 A1 * 3/2011 Guesnon ..... E21B 17/085 166/367
2011/0127040 A1 6/2011 Humphreys
2011/0253445 A1 10/2011 Hannegan et al.
2012/0255783 A1 10/2012 Curtis et al.
2012/0273218 A1 11/2012 Orbell et al.
2013/0233562 A1 9/2013 Leuchtenberg
2014/0048331 A1 2/2014 Boutalbi et al.
2014/0209316 A1 * 7/2014 Tindle ..... E21B 33/035 166/345

* cited by examiner

RISER GAS HANDLING SYSTEM

CROSS-REFERENCE TO RELATED APPLICATION

This application is a Non-Provisional Application and claims priority to U.S. Provisional Patent Application No. 61/801,884, entitled "Riser Gas Handling System", filed Mar. 15, 2013, which is herein incorporated by reference.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. According, it should be understood that these statements are to be read in this light, and not as admissions of prior art.

Natural resources, such as oil and gas, are used as fuel to power vehicles, heat homes, and generate electricity, in addition to a myriad of other uses. Once a desired resource is discovered below the surface of the earth, drilling and production systems are often employed to access and extract the resource. These systems may be located offshore depending on the location of a desired resource. These systems enable drilling and/or extraction operations.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

The disclosed embodiments include a modular riser gas handling system capable of changing configuration depending on the type of drilling operation. Specifically, the modular riser gas handling system may include separable assemblies (e.g., rotating control unit, annular BOP, diverter) capable of coupling and decoupling to adjust for different drilling operations. In operation, the riser gas handling system blocks the flow materials (e.g., mud, cuttings, natural resources) to the drill floor of a platform or ship by diverting the materials to another location. However, different types of drilling operations may involve different methods with different equipments needs. For example, in managed pressure drilling operations the riser gas handling system may include a rotating control unit assembly, an annular BOP assembly, and a diverter assembly. However, in another drilling operation a rotating control unit may be unnecessary. Accordingly, the modularity of the riser gas handling system enables the selection and exclusion of different pieces of equipment depending on the drilling operation. Moreover, the modularity of the riser gas handling system 12 facilitates storage, movement, and assembly on site.

Figure 1:
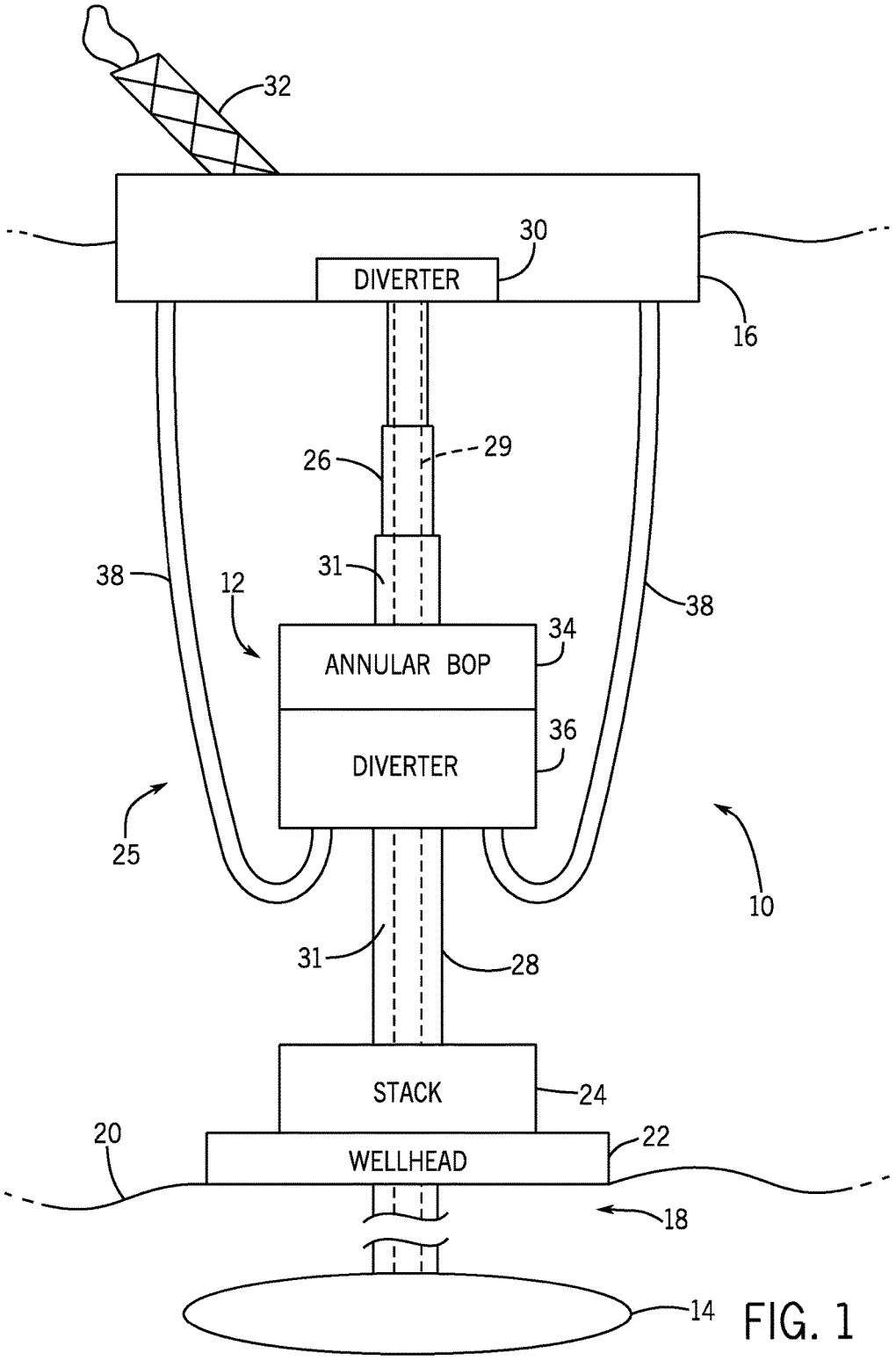
FIG. 1 a schematic of a mineral extraction system with a riser gas handler system according to an embodiment.

FIG. 1 is a schematic of a mineral extraction system 10 with a riser gas handling system 12. The mineral extraction system 10 is used to extract oil, natural gas, and other natural resources from a subsea mineral reservoir 14. As illustrated, a ship or platform 16 positions and supports the mineral extraction system 10 over a mineral reservoir 14 enabling the mineral extraction system 10 to drill a well 18 through the sea floor 20. The mineral extraction system 10 includes a wellhead 22 to that forms a structural and pressure containing interface between the well 18 and the sea floor 20. Attached to the wellhead 22 is a stack 24. The stack 24 may include among other items blowout preventers (BOPs) that enable pressure control during drilling operations. In order to drill the well 18, an outer drill string 25 couples the ship or platform to the wellhead 22. The outer drill string 25 may include a telescoping joint 26 and a riser 28. The telescoping joint 26 enables the mineral extraction system 10 to flexible respond to up and down movement of the ship or platform 16 on an unstable sea surface.

In order to drill the well 18, an inner drill string 29 (i.e., a drill and drill pipe) passes through the telescoping joint 26 and the riser 28 to the sea floor 20. During drilling operations the inner drill string 29 drills through the sea floor as drilling mud is pumped through the inner drill string 29 to force the cuttings out of the well 18 and back up the outer drill string 25 (i.e., in a space 31 between the outer drill string 25 and the inner drill string 29) to the drill ship or platform 16. When the well 18 reaches the mineral reservoir 14 natural resources (e.g., natural gas and oil) start flowing through the wellhead 22, the riser 28, and the telescoping joint 26 to the ship or platform 16. As natural gas reaches the ship 16, a diverter system 30 diverts the mud, cuttings, and natural resources for separation. Once separated, natural gas may be sent to a flare 32 to be burned. However, in certain circumstances it may be desirable to divert the mud, cuttings, and natural resources away from a ship's drill floor. Accordingly, the mineral extraction system 10 includes a riser gas handling system 12 that enables diversion of mud, cuttings, and natural resources before they reach a ship's drill floor.

The riser gas handling system 12 may include an annular BOP assembly 34 and a diverter assembly 36. In some embodiments, the riser gas handler 12 may be a modular system wherein the annular BOP assembly 34 and the diverter assembly 36 are separable components capable of on-site assembly. The riser gas handling system 12 uses the annular BOP assembly 34 and the diverter assembly 36 to stop and divert the flow of natural resources from the well 18, which would normally pass through the outer drill string 25 that couples between the ship or platform 16 and the wellhead 22. Specifically, when the annular BOP assembly 34 closes it prevents natural resources from continuing through the outer drill string 25 to the ship or platform 16. The diverter assembly 36 may then divert the flow of natural resources through drape hoses 38 to the ship or platform 16 or prevent all flow of natural resources out of the well 18.

In operation, the riser gas handling system 12 may be used for different reasons and in different circumstances. For example, during drilling operations it may be desirable to temporarily block the flow of all natural resources from the well 18. In another situation, it may be desirable to divert the flow of natural resources from entering the ship or platform 16 near or at a drill floor. In still another situation, it may be desirable to divert natural resources in order to conduct maintenance on mineral extraction equipment above the annular BOP assembly 34. Maintenance may include replacement or repair of the telescoping joint 26, among other pieces of equipment. The riser gas handling system 12 may also reduce maintenance and increase the durability of the telescoping joint 26. Specifically, by blocking the flow of natural resources through the telescoping joint 26 the riser gas handling system 12 may increase the longevity of seals (i.e., packers) within the telescoping joint 26.

Figure 2:
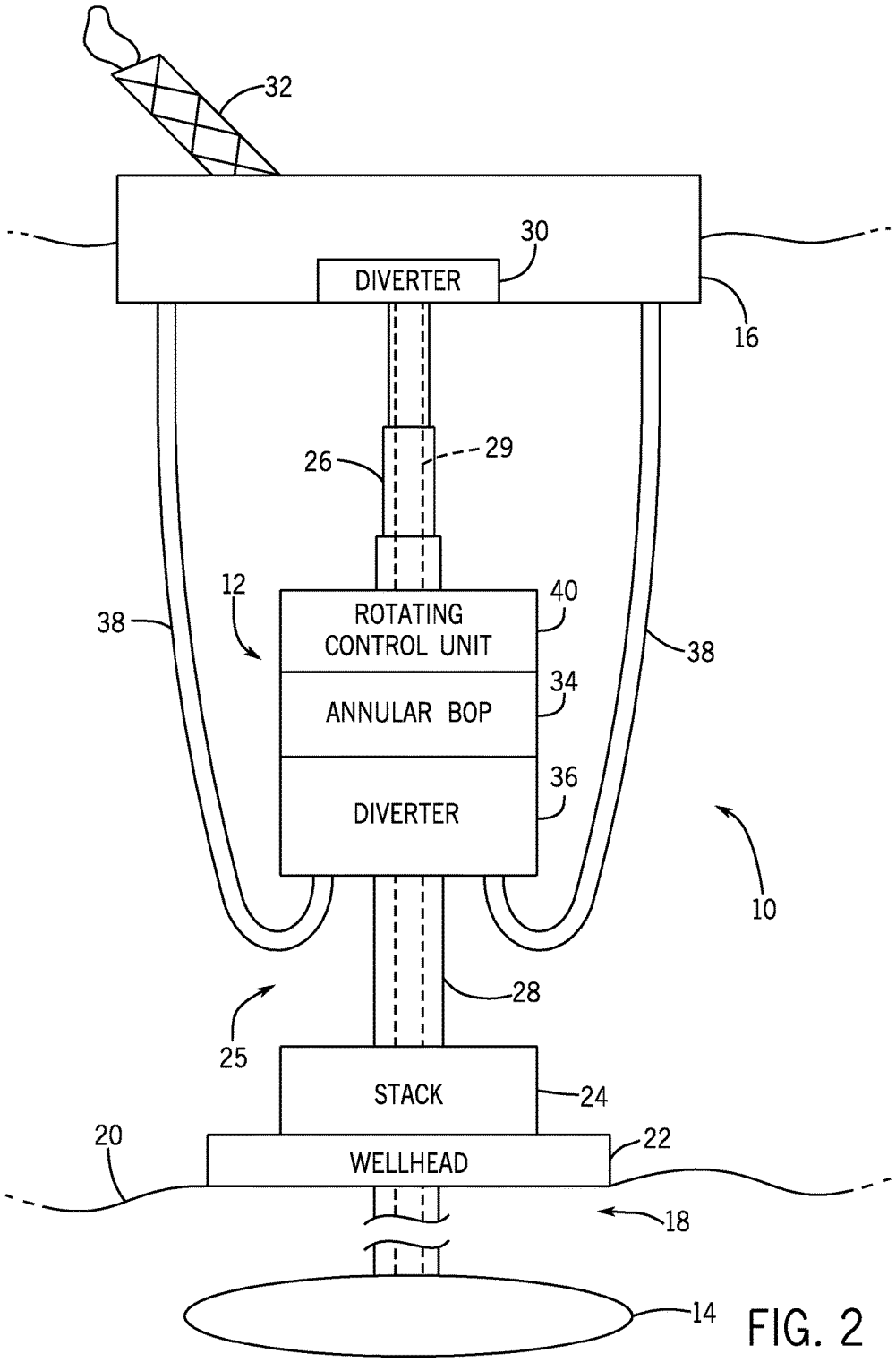
FIG. 2 a schematic of a mineral extraction system with a riser gas handler system according to an embodiment.

FIG. 2 is a schematic of another mineral extraction system 10 with a riser gas handling system 12. The mineral extraction system 10 of FIG. 2 may use managed pressure drilling to drill through a sea floor made of softer materials (i.e., materials other than only hard rock). Managed pressure drilling regulates the pressure and flow of mud flowing through the inner drill string to ensure that the mud flow into the well 18 does not over pressurize the well 18 (i.e., expand the well 18) or allow the well to collapse under its own weight. The ability to manage the drill mud pressure therefore enables drilling of mineral reservoirs 14 in locations with softer sea beds.

The riser gas handling system 12 of FIG. 2 is a modular system for managed pressure drilling. As illustrated, the riser gas handling system 12 includes three components the annular BOP assembly 34, the diverter assembly 36, and the rotating control unit assembly 40. In operation, the rotating control unit assembly 40 forms a seal between the inner drill string 29 and the outer drill string 25 (e.g., the telescoping joint 26), which prevents mud, cutting, and natural resources from flowing through the telescoping joint 26 and into the drill floor of a platform or ship 16. The rotating control unit assembly 40 therefore blocks CO2, H2S, corrosive mud, shallow gas, and unexpected surges of material flowing through the outer drill string 25 from entering the drill floor. Instead, the mud, cuttings, and natural resources return to the ship or platform 16 through the drape hoses 38 coupled to the diverter assembly 36. As explained above, the modularity of the riser gas handling system 12 enables maintenance on mineral extraction equipment above the annular BOP assembly 34. Maintenance may include replacement or repair of the telescoping joint 26, the rotating control unit assembly 40, among other pieces of equipment. Moreover, the modularity of the riser gas handling system 12 facilitates storage, movement, assembly on site, and as will be explained in further detail below enables different configurations depending on the needs of a particular drilling operation.

Figure 3:
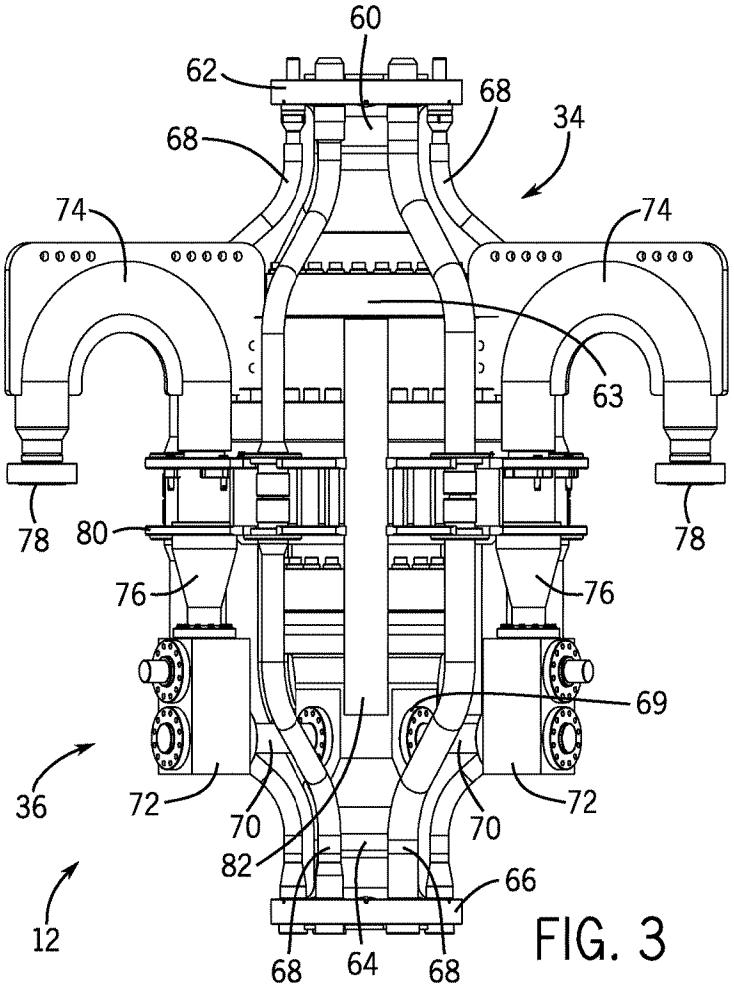
FIG. 3 is a front view of a riser gas handler system according to an embodiment.

FIG. 3 is a front view of a riser gas handling system 12 in one configuration. In the illustrated embodiment, the riser gas handling system 12 includes an annular BOP assembly 34 and a diverter assembly 36 combined together. However, in managed pressure drilling operations, the riser gas handling system 12 may change configurations by coupling the annular BOP assembly 34 and the diverter assembly 36 to a rotating control unit assembly 40. The modularity of the riser gas handling system 12 enables on-site modification to facilitate different kinds of drilling operations.

As illustrated, the riser gas handling system 12 includes an upper BOP spool connector 60 with a connector flange 62. The upper BOP spool adapter connector 60 enables the annular BOP assembly 34 with the annular BOP 63 to couple to other components in the mineral extraction system 10. For example, during managed pressure drilling operations the upper BOP spool connector 60 enables the annular BOP assembly 34 to couple to a rotating control unit assembly 40. In another situation, the upper BOP spool connector 60 may couple to the telescoping joint 26. On the opposite end of the riser gas handling system 12 is a lower diverter spool connector 64 coupled to the annular BOP 63. The lower diverter spool connector 64 includes a connector flange 66 that enables the lower diverter spool connector 64 to couple to the riser 28, placing the riser gas handling system 12 in the fluid path of mud, cutting, and natural resources flowing through the riser 28 to the platform or ship 16 above. In between the upper spool connector 60 and the lower diverter spool connector 64 are multiple lines or hoses 68. The lines 68 may be hydraulic lines, mud boost lines, control lines, fluid lines, or a combination thereof. The lines 68 on the riser gas handling system 12 enable fluid communication with lines above and below the riser gas handler 12.

In order to divert mud, cuttings, and natural resources from coming through the riser 28, the diverter assembly 36 includes apertures 69 in the lower diverter spool connector 64. The flange spools 70 couple to the apertures 69 and divert materials flowing through the riser 28 towards valves 72. When open the valves 72 divert material to the gooseneck connection 74 through valve connectors 76. As illustrated, the gooseneck connectors 74 form a semi-annular shape with drape connection ports 78. The drape hoses 38 are then able to couple to these ports 78 enabling material to flow to the platform or ship 16. When connected, the drape hoses 38 may move with subsea currents creating torque on the flange spools 70. In some embodiments, the riser gas handler 12 includes gooseneck support bracket(s) 80. The bracket(s) 80 may relieve or block rotational stress on the flange spools 70 increasing the durability of the diverter assembly 36.

In operation, the valves 72 open and close in response to the hydraulics stored in accumulators 82. As explained above, the riser gas handling system 12 may be used for different reasons and in different circumstances. For example, during drilling operations it may be desirable to temporarily block the flow of all natural resources from the well 18. In another situation, it may be desirable to divert the flow of natural resources from entering the ship or platform 16 near or at a drill floor. In still another situation, it may be desirable to divert natural resources in order to conduct maintenance on mineral extraction equipment above the annular BOP assembly 34. Accordingly, the valves 72 may be opened or closed depending on the need to divert materials or to stop the flow of all materials to the ship or platform 16. However, in other embodiments, the diverter system 36 may facilitate the injection of fluids (e.g., mud, chemicals, water) into the outer drill string 25 through one or more of the gooseneck connections 74. In still other embodiments, the diverter assembly 36 may facilitate injection of materials and the extraction of materials through different gooseneck connections 74 and valves 72 simultaneously or by alternating between injection and extraction.

Figure 4:
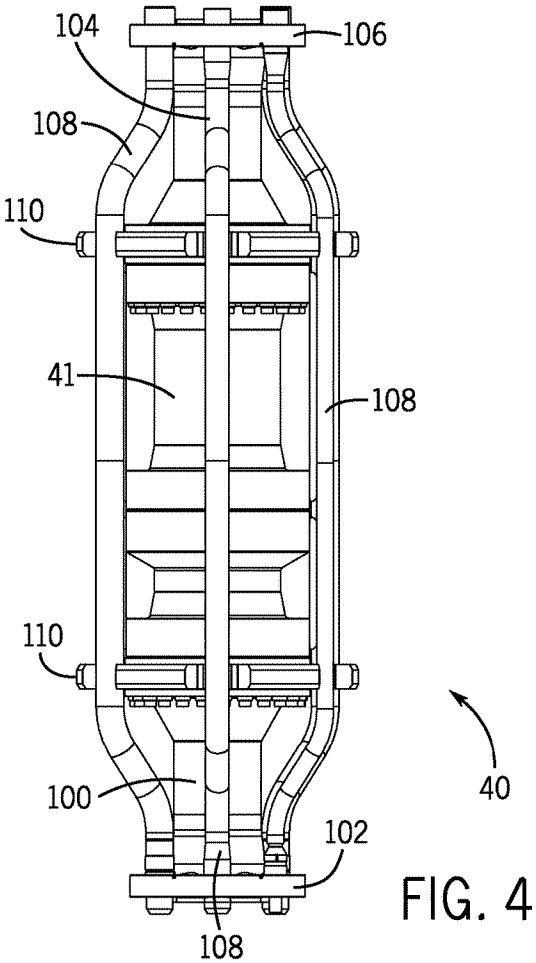
FIG. 4 is a front view of a rotating control unit according to an embodiment.

FIG. 4 is a front view of a rotating control unit (RCU) assembly 40. As explained above, the modularity of the riser gas handling system 12 enables the attachment and detachment of the RCU assembly 40, depending on the drilling operation. The RCU assembly 40 includes an RCU 41 coupled to a lower RCU spool connector 100. The lower RCU spool connector 100 includes a connecting flange 102 that enables coupling of the RCU assembly 40 to the connecting flange of a BOP spool connector. Opposite the lower RCU spool connector 100 is an upper RCU spool connector 104 with a connector flange 106. The upper RCU spool connector 104 couples to the RCU 41 opposite the lower RCU spool connector 100 and enables coupling to the telescoping joint 26. In between the upper RCU spool connector 104 and the lower RCU spool connector 100 are multiple lines or hoses 108. The lines 108 may be hydraulic lines, mud boost lines, control lines, fluid lines, or a combination thereof. The lines 108 on the RCU assembly 40 enable continued fluid communication with lines above and below the RCU assembly 40. In some embodiments, the RCU assembly 40 may include support clamp connections 110 to provide additional support for the lines 108.

Figure 5:
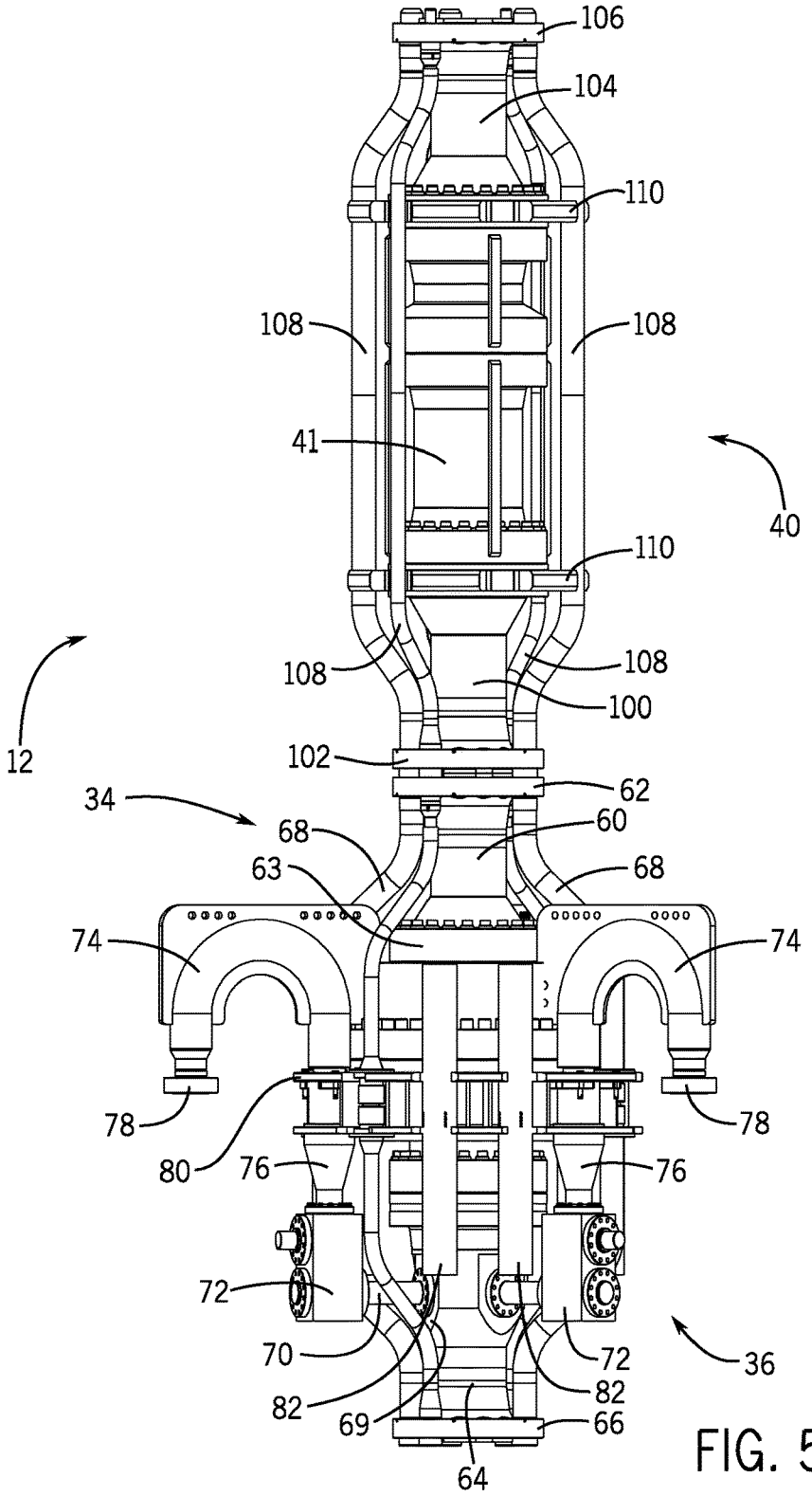
FIG. 5 is a front view of a riser gas handler system according to an embodiment.

FIG. 5 is a front view of an embodiment of a riser gas handling system 12 including the annular BOP assembly 34, the diverter assembly 36, and the RCU assembly 40. As illustrated, the connector flange 102 of the lower RCU spool connector 100 couples to the connector flange 62 of the upper BOP spool connector 60. Furthermore, the connection of the lower RCU spool connector 100 to the upper BOP spool connector 60, connects the lines 108 to the lines 68 enabling fluid communication between lines above RCU assembly 40 and lines below the diverter assembly 36. The modularity of the riser gas handling system 12 enables the RCU assembly 40 to couple and decouple, which increases the flexibility of the riser gas handling system 12 to operate in different drilling operations.

Figure 6:
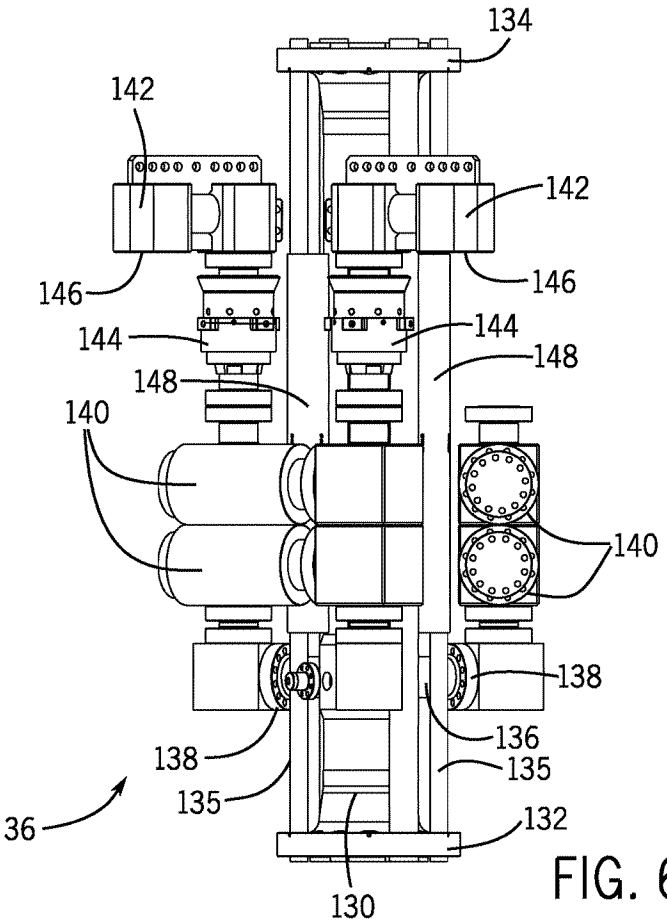
FIG. 6 is a front view of diverter according to an embodiment.

FIG. 6 is a front view of diverter assembly 36 capable of coupling to an annular BOP assembly 34 in a riser gas handling system 12. The diverter assembly 36 includes a multi-port spool 130 with upper and lower connector flanges 132 and 134. The connector flanges 132 and 134 couple the multi-port spool 130 to neighboring components in the mineral extraction system 10. Specifically, the upper connector flange 134 enables attachment to an annular BOP assembly 34, while the lower connector flange 132 enables attachment to the riser 28. In between the connector flanges 132 and 134 of the multi-port spool 130 are multiple lines or hoses 135. The lines 135 may be hydraulic lines, mud boost lines, control lines, fluid lines, or a combination thereof. The lines 135 on the diverter assembly 36 enable continued fluid communication with lines above and below the diverter assembly 36.

As explained above, the diverter assembly 36 may divert mud, cuttings, and natural resources from coming through the riser 28 through apertures 136. Coupled to the apertures 136 are diverters 138 that enable material to flow out of the multi-port spool 130 to the valves 140. When open the valves 140 divert material to the gooseneck connection 142 through valve connectors 144. As illustrated, the gooseneck connectors 142 form a semi-annular shape with drape connection ports 146. The drape hoses 38 are then able to couple to these ports 146 facilitating material flow to the platform or ship 16.

In operation, the valves 140 open and close in response to the hydraulics stored in accumulators 148. As explained above, the riser gas handling system 12 may be used for different reasons and in different circumstances. For example, during drilling operations it may be desirable to temporarily block the flow of all natural resources from the well 18. In another situation, it may be desirable to divert the flow of natural resources from entering the ship or platform 16 near or at a drill floor. In still another situation, it may be desirable to divert natural resources in order to conduct maintenance on mineral extraction equipment above the annular BOP assembly 34. Accordingly, the valves 140 may be opened or closed depending on the need to divert materials or to stop the flow of all materials to the ship or platform 16.

Figure 7:
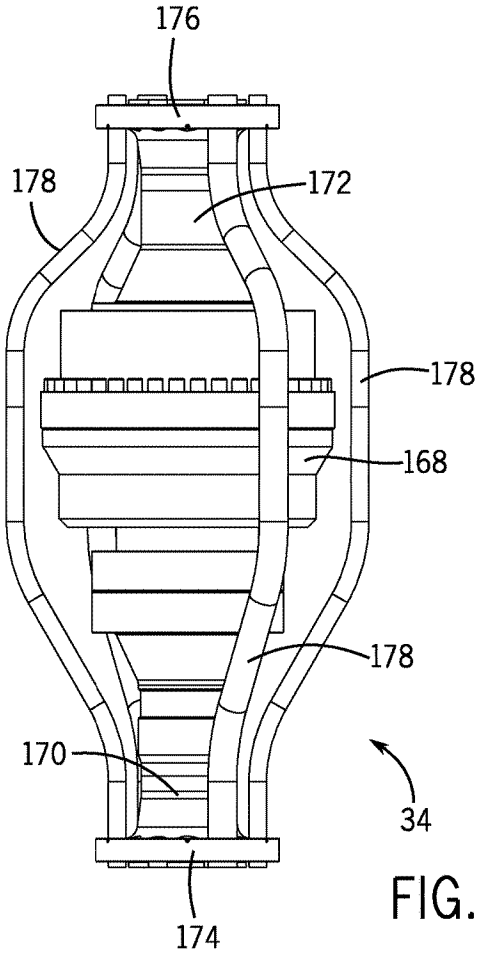
FIG. 7 is a front view of an annular blowout preventer according to an embodiment.

FIG. 7 is a front view of an annular BOP assembly 34. The annular BOP assembly 34 includes an annular BOP 168 between a lower BOP spool connector 170 and an upper BOP spool connector 172. The lower BOP spool connector 170 includes a connecting flange 174 that enables coupling of the annular BOP assembly 34 to the diverter assembly 36. The annular BOP assembly 34 also includes an upper BOP spool connector 172 with connector flange 176. The connector flange 176 of the upper BOP spool connector 172 enables the annular BOP assembly 34 to couple to the telescoping joint 26, or the rotating control unit assembly 40, among other pieces of equipment. In between the lower BOP spool connector 170 and the upper BOP spool connector 172 are multiple lines or hoses 178. The lines 178 may be hydraulic lines, mud boost lines, control lines, fluid lines, or a combination thereof. The lines 178 on the annular BOP assembly 34 enable continued fluid communication with lines above and below the annular BOP assembly 34.

Figure 8:
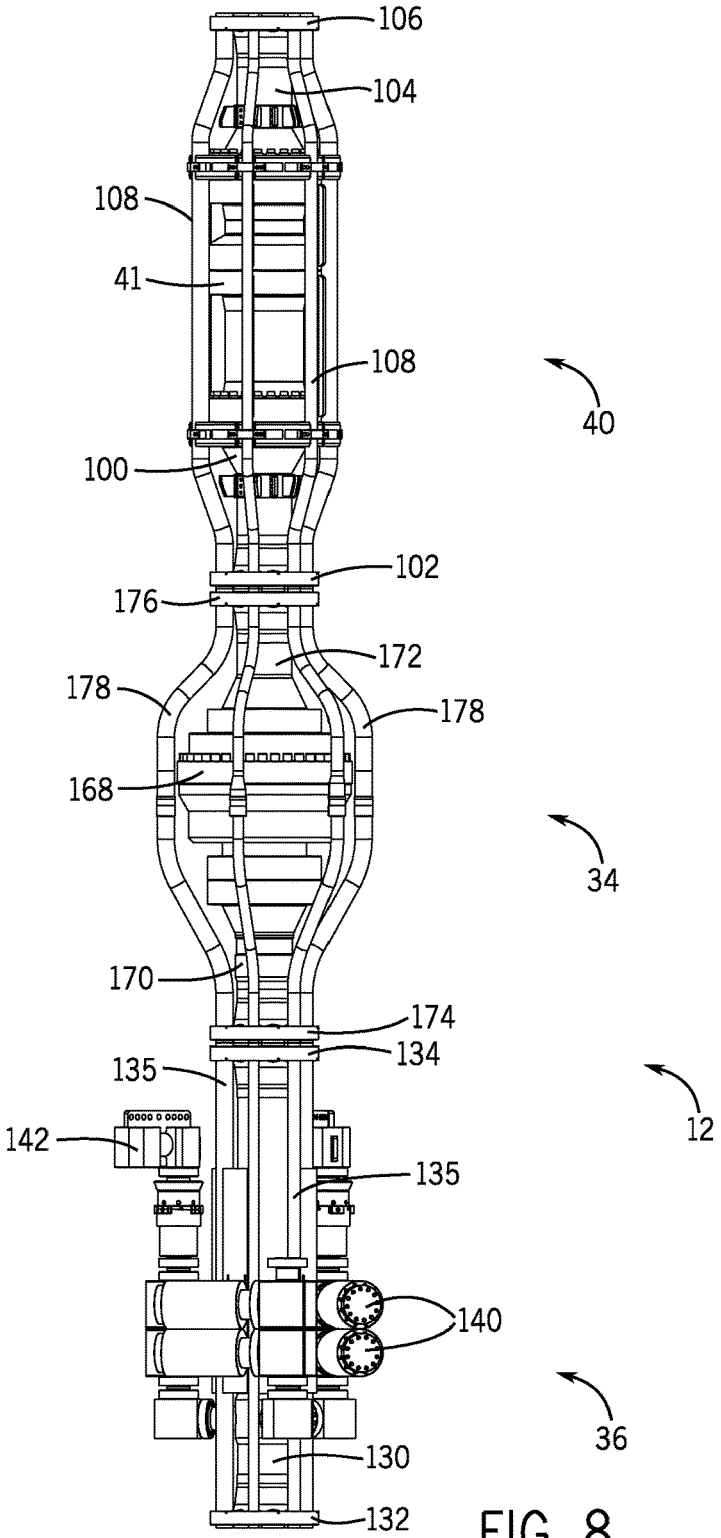
FIG. 8 is a front view of a riser gas handler system according to an embodiment.

FIG. 8 is a front view of a riser gas handling system 12. In the illustrated configuration, the modular riser gas handling system 12 couples all of the assemblies together (e.g., the diverter assembly 36, the annular BOP assembly 34, and the RCU assembly 40). Specifically, the connection flange 134 of the diverter assembly 36 couples to the connector flange 174 of the annular BOP assembly 34, and the annular BOP connector flange 176 couples to the connector flange 102 of the RCU assembly 40. The connection of the diverter assembly 36, the annular BOP assembly 34, and the RCU assembly 40 enables fluid communication between lines above RCU assembly 40 and lines below the diverter assembly 36. In the illustrated configuration, the riser gas handling system 12 may assist in managed pressure drilling operations. However, the riser gas handling system 12 may have different configurations including a configuration with only the diverter assembly 36 and the annular BOP assembly 34. The modularity of the riser gas handling system 12 enables on-site modification to facilitate different kinds of drilling operations, as well as replacement of different components in the riser gas handling system 12.

Figure 9:
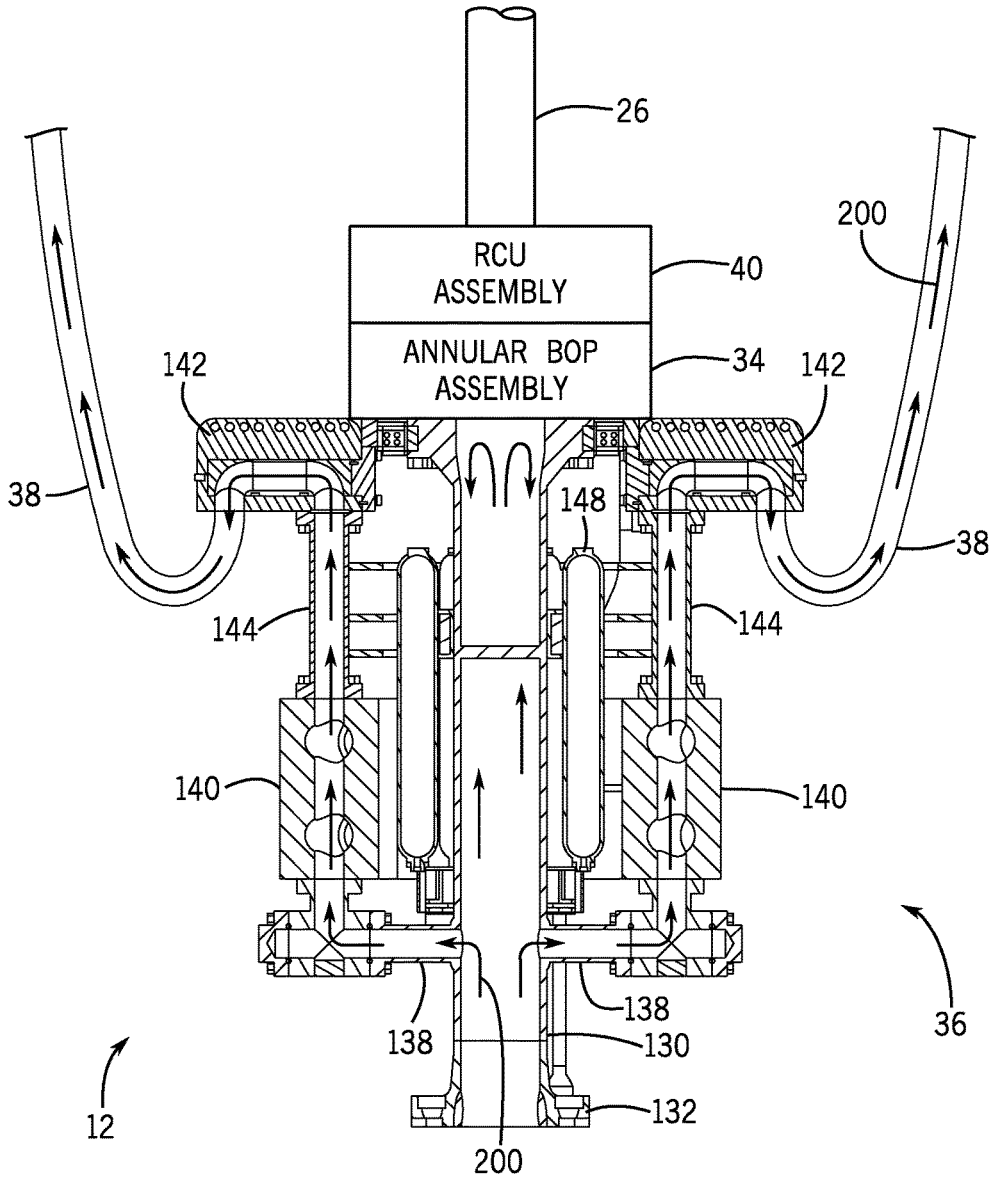
FIG. 9 is a cross-sectional view of a diverter according to an embodiment.

FIG. 9 is a cross-sectional view of a diverter assembly 36 coupled to the annular BOP assembly 34. As explained above, the riser gas handler assembly 12 may block the flow of material 200 (e.g., mud, cuttings, natural resources) through the outer drill string 25 (i.e., through the telescoping joint 26) with either an annular BOP assembly and/or an RCU assembly 40. When the riser gas handling system 12 blocks the flow material 200 the material 200 may remain within the riser 28 or be redirected through the diverter assembly 36. As illustrated, the valves 140 of the diverter system 36 are open enabling the flow of material 200 through the diverter system 36 to the gooseneck connections 142 where the material 200 enters the drape hoses 38 for deliver to the platform or ship 16. However, in other embodiments, the diverter system 36 may facilitate the injection of fluids (e.g., mud, chemicals, water) into the outer drill string 25 through the gooseneck connections 142. In still other embodiments, the diverter assembly 36 may facilitate injection of fluids and the extraction of the materials 200 through different gooseneck connection 142 and valves 140 simultaneously or by alternating between injection and extraction.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a modular riser gas handling system configured to couple to and be disposed vertically below a telescoping joint, wherein the modular riser gas handling system comprises:

a diverter assembly comprising a first central portion and a plurality of first lines extending between and through an offset pair of first flanges, wherein the diverter assembly is configured to couple to and divert a flow of material into and out of a riser, and wherein the plurality of first lines is spaced circumferentially about the first central portion and the offset pair of first flanges; and an annular blow out preventer (BOP) assembly comprising a second central portion and a plurality of second lines extending between and through an offset pair of second flanges, wherein the plurality of second lines is spaced circumferentially about the second central portion and the offset pair of second flanges, wherein an adjacent pair of the first and second flanges is configured to couple together the first and second central portions and the plurality of first and second lines of the diverter assembly and the annular BOP, wherein the annular BOP assembly is separable from the diverter assembly, such that the modular riser gas handling system is configured to change a sequence of the annular BOP assembly and the diverter assembly, and wherein the annular BOP assembly and the diverter assembly are configured to be removed from the modular riser gas handling system.

2. The system of claim 1, wherein the annular BOP assembly is configured to couple to the telescoping joint.

3. The system of claim 1, wherein the riser gas handling system comprises a rotating control unit assembly comprising a third central portion and a plurality of third lines extending between and through an offset pair of third flanges, the plurality of third lines is spaced circumferentially about the third central portion and the offset pair of third flanges, and the rotating control unit assembly is configured to couple to the annular BOP assembly via an adjacent pair of the second and third flanges.

4. The system of claim 3, wherein the rotating control unit assembly is disposed vertically above the annular BOP assembly.

5. The system of claim 3, wherein the diverter assembly, the annular BOP assembly, and the rotating control unit assembly are removably stackable together via the adjacent pairs of the first, second, and third flanges.

6. The system of claim 1, wherein the diverter assembly comprises a multiport spool.

7. The system of claim 6, wherein the diverter assembly comprises a valve fluidly coupled to the multiport spool, and the valve is configured to block or divert the flow of material in and out of the riser.

8. The system of claim 7, wherein the diverter assembly comprises a gooseneck connector fluidly coupled to the valve, and the gooseneck connector is configured to couple to a drape hose.

9. The system of claim 8, wherein the diverter assembly includes a gooseneck support bracket that resists rotation of the gooseneck connector.

10. The system of claim 1, wherein the diverter assembly comprises a first flow path through a first valve and a second flow path through a second valve.

11. The system of claim 1, wherein the plurality of first and second lines comprise hydraulic lines, mud boost lines, control lines, fluid lines, or a combination thereof.

12. The system of claim 1, wherein the plurality of first and second lines extend in an axial direction along a central axis defining the first central portion, the second central portion, or both.

13. A system, comprising:

a modular riser gas handling system, comprising:

a rotating control unit assembly comprising a first central portion and a plurality of first lines extending between and through an offset pair of first flanges, wherein the plurality of first lines is spaced circumferentially about the first central portion and the offset pair of first flanges;

an annular blow out prevent (BOP) assembly comprising a second central portion and a plurality of second lines extending between and through an offset pair of second flanges, wherein the plurality of second lines is spaced circumferentially about the second central portion and the offset pair of second flanges; and a diverter assembly comprising a third central portion and a plurality of third lines extending between and through an offset pair of third flanges, wherein the plurality of third lines is spaced circumferentially about the third central portion and the offset pair of third flanges, wherein the diverter assembly excludes an annular BOP, wherein the rotating control unit assembly, the annular BOP assembly, and the diverter assembly are configured to couple together in a stacked arrangement via adjacent pairs of the first, second, and third flanges, wherein the modular riser gas handling system is configured to change a sequence of the rotating control unit assembly, the annular BOP assembly, and the diverter assembly, and wherein the rotating control unit assembly, the annular BOP assembly, and the diverter assembly are configured to be removed from the modular riser gas handling system.

14. The system of claim 13, wherein the rotating control unit assembly couples to and is vertically disposed above the annular BOP assembly via an adjacent pair of the first and second flanges.

15. The system of claim 13, wherein the annular BOP assembly couples to and is vertically disposed above the diverter assembly via an adjacent pair of the second and third flanges.

16. The system of claim 13, wherein the modular riser gas handling system is vertically disposed below a telescoping joint.

17. The system of claim 13, wherein the diverter assembly comprises a first flow path through a first valve and a second flow path through a second valve.

18. The system of claim 13, wherein the plurality of first, second, and third lines comprise hydraulic lines, mud boost lines, control lines, fluid lines, or a combination thereof.

19. The system of claim 13, wherein the plurality of first, second, and third lines extend in an axial direction along a central axis defining the first central portion, the second central portion, the third central portion, or a combination thereof.

20. A system, comprising:

a modular system, comprising:

an annular blow out preventer (BOP) assembly comprising a first central portion and a plurality of first lines extending between and through an offset pair of first flanges, wherein the plurality of first lines is spaced circumferentially about the first central portion and the offset pair of first flanges; and a diverter assembly comprising a second central portion and a plurality of second lines extending between and through an offset pair of second flanges, wherein the plurality of second lines is spaced circumferentially about the second central portion and the offset pair of second flanges, wherein the annular BOP assembly and the diverter assembly are configured to couple together the first and second central portions and the plurality of first and second lines of the diverter assembly and the annular BOP with an adjacent pair of the first and second flanges, wherein the modular system is configured to change a sequence of the annular BOP assembly and the diverter assembly, and wherein the annular BOP assembly and the diverter assembly are configured to be removed from the modular system.

21. The system of claim 20, wherein the modular system is configured to mount vertically below a height adjustable joint.

22. The system of claim 20, wherein the modular system comprises a rotating control unit assembly comprising a third central portion and a plurality of third lines extending between and through an offset pair of third flanges, wherein the plurality of third lines is spaced circumferentially about the third central portion and the offset pair of third flanges.

23. The system of claim 20, wherein the modular system comprises a modular riser gas handling system configured to couple to a riser.

24. The system of claim 20, wherein the diverter assembly comprises a gooseneck connector, and the gooseneck connector couples to the annular BOP assembly.

25. The system of claim 20, wherein the plurality of first and second lines comprise hydraulic lines, mud boost lines, control lines, fluid lines, or a combination thereof.

26. The system of claim 20, wherein the plurality of first and second lines extend in an axial direction along a central axis defining the first central portion, the second central portion or both.

* * * * *